US006235084B1

(12) United States Patent
Schöler et al.

(10) Patent No.: US 6,235,084 B1
(45) Date of Patent: May 22, 2001

(54) METHOD FOR DECARBURIZING STEELS MELTS

(75) Inventors: Horst-Dieter Schöler; Volker Wiegmann; Rainer Dittrich, all of Duisburg (DE); Frank Haers, Kaprijke; Leo Peeters, Bassevelde, both of (BE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/077,040

(22) PCT Filed: Nov. 6, 1996

(86) PCT No.: PCT/DE96/02165

§ 371 Date: Jul. 24, 1998

§ 102(e) Date: Jul. 24, 1998

(87) PCT Pub. No.: WO97/19197

PCT Pub. Date: May 29, 1997

(30) Foreign Application Priority Data

Nov. 17, 1995 (DE) ..... 195 44 166
Dec. 13, 1995 (DE) ..... 195 48 641

(51) Int. Cl.[7] ..... C21C 7/10
(52) U.S. Cl. ..... 75/512; 266/208
(58) Field of Search ..... 75/512; 266/208

(56) References Cited

U.S. PATENT DOCUMENTS 5,902,374 * 5/1999 Kitamura et al. ..... 75/512
5,931,985 * 8/1999 Schoeler et al. ..... 75/512

FOREIGN PATENT DOCUMENTS 53-81418 * 7/1978 (JP) .
789 591 * 12/1980 (SU) ..... 75/512

* cited by examiner

*Primary Examiner*—Melvyn Andrews
(74) *Attorney, Agent, or Firm*—Cohen, Pontani, Lieberman & Pavane

(57) ABSTRACT

The invention relates to a process for decarburizing a steel melt in a closed metallurgical vessel that is connected to a vacuum unit which includes reducing pressure in the vessel to below 100 mbar, introducing replenishment oxygen to implement the removal of carbon, introducing a predetermined additional amount of oxygen, and introducing a combustible metallic substance with the additional amount of oxygen. The invention also relates to an apparatus for performing the above process including the closable vessel, measurement elements for determining melt temperature and pressure, and a controller for controlling the amount of additional oxygen and combustible metallic substance in response to the melt temperature and pressure.

4 Claims, 3 Drawing Sheets

METHOD FOR DECARBURIZING STEELS MELTS

BACKGROUND OF THE INVENTION

1. Field of the Invention

The invention relates to a process for decarburizing steel melts in a closed metallurgical vessel that is attached to a vacuum unit and into which oxygen is fed via a lance and combustible material is fed via a feed device. The invention also relates to a hollow device for implementing this process.

2. Description of the Prior Art

In what is known as "forced decarburization," oxygen is added during the decarburization phase. The addition of oxygen is always necessary when the oxygen present in the steel is insufficient for decarburization or is so low that the required C removal is not completed in the available time. In processes of this type, for example, immersion tubes of an RH vessel are submerged into the melt. When pressure reduction begins in the RH vessel, the decarburization process begins simultaneously as a function of the pressure reduction. When a low pressure of $p<100$ mbar is reached, through a hollow oxygen lance $O_2$ is blown for approximately 1 to 3 minutes. During the deep vacuum phase, self-decarburization takes place; after deoxidation, decarburization is ended.

During decarburization, up to 70% CO is formed. Part of this gas automatically reacts with part of the added oxygen to form $CO_2$. The degree of post-combustion in this method is less than 30%.

Moreover, it is also a metallurgical practice to add aluminum for the purpose of chemically heating steel melts in atmospheric units. During such chemical heating, the energy gained from the combustion of the aluminum with the added oxygen is used to heat the melt.

In addition to its use in purely thermal heating, aluminum may also be used with other substances to treat the melt. For example, EP 0 110 809 discloses a process for treating steel in a ladle with reactive slags. This process calls for a metal-thermal reaction, whereby oxygen is blown through a lance into a bell submerged in the melt. Combustible metal substances react and, as reactive slags form, a neutral or reductive flush gas is blown in below the tube in which the steel treatment occurs.

The disadvantage of this process, which is used for the desulphurization, deoxidation and purification reaction of steel melts, is the formation of reactive slags, that are created in the bell submerged into the molten metal.

Further, EP 0 347 884 B1 discloses a process for the degasification and desulphurization of molten steel, wherein steel is fed through a container into a vacuum chamber. Arranged in the vacuum chamber at a given distance is an oxygen lance, from which oxygen or a gas containing oxygen is blown in for the purpose of combusting the CO in the surface region of the molten steel located in the vacuum chamber. An amount of oxygen fed through the lance is in accordance with a predetermined ratio of $(CO+CO_2)$/waste gas quantity or $CO/(CO+CO_2)$,.

From this process, it is not possible to derive the chemical heating of the melt under particular pressure conditions and the blowing in of a defined quantity of surplus oxygen.

SUMMARY OF THE INVENTION

The object of the invention is to create a process and a device for decarburizing a steel melt that, while realizing a high degree of oxidic purity, shorten the decarburizing time and/or reduce the final carbon content.

According to the invention, a process for decarburizing a metal melt in a closed mettalurgical vessel that is connected to a vacuum unit includes reducing pressure in the vessel to below 100 mbar, introducing replenishment oxygen to implement the removal of carbon, introducing a predetermined additional amount of oxygen, and introducing a combustible metallic substance with the additional amount of oxygen.

According to the invention, in addition to the replenishment oxygen used for carbon removal during the decarburization phase, additional oxygen is blown in simultaneously with a metallic combustion substance that is added in a distributed fashion during the first 10 minutes following completion of the step of adjusting the pressure to below 100 mbar.

In known vacuum units, until now, only killed cast (Al, Si or Al—Si deoxidation) melts and non-killed cast melts (decarburization melts) have been chemically heated after decarburization and subsequent deoxidation. The reason is the decrease in the oxygen needed for decarburization upon addition of the heating aluminum. The energy gain that results, during the reaction, from the combustion of the aluminum with the added oxygen is utilized. However, the decarburization reaction is sharply slowed in this process and the decarburization oxygen to be expected is not achieved.

According to the invention, this advantage is avoided, and the temperature loss occurring during decarburization is compensated for, by means of the heating process using aluminum or similar products. With the proposed addition of oxygen, a partial oxygen surplus of limited duration occurs in the melt during the first 10 minutes of blowing time after the adjustment of the pressure to below 100 mbar. The partial oxygen surplus is the extra oxygen needed during decarburization or non-killed melts in vacuum units to combust metallic combustion substances or combustible mixtures without disadvantageously influencing the decarburization process. This surplus has positive thermodynamic and kinetic effects and promotes the decarburization process in a surprising manner. The decarburization reaction [C]+[O]=(CO), which is highly pressure-dependent and, in particular, temperature-dependent, is accelarated. This is because the strong overheating that occurs briefly during the chemical heating of a partial melt, especially in the RH vessel, has a catalytic effect on the decarburization reaction.

Furthermore, the chemical heating means, e.g., granular aluminum, can be used in a special manner to accelerate decarburization. Along with the thermodynamic effect, the reaction kinetics are influenced by the $A1_2O_3$ particles formed during heating. These deoxidation products act as foreign germinative bodies and thus act in a forcing manner on the speed of decarburization, especially by forming CO bubbles.

In an advantageous embodiment, a combination lance is used to convey both the oxygen and the metallic combustion substances. However, when especially coarse-grained materials are used, it is proposed that they be fed to the vessel via a separate tube.

This process permits the realization of every partial temperature increase during decarburization in a vacuum. This has the advantage of compensating for typical temperature losses due, for example, to inadequately preheated treatment vessels or steel ladles or to delays resulting from transport or extended treatment times.

The targeted chemical heating of decarburization melts during the decarburization phase makes it possible to reduce the converter or ultra high power (UHP) furnace tap temperatures.

In converter furnaces, this reduction in tap temperatures facilitates higher durability, high variability in solid scrap use, and shorter tap-to-tap times, and in electric arc furnaces, the reduction in tap temperatures facilitates shorter tap-to-tap times, lower specific electrolode use and lower specific energy use.

BRIEF DESCRIPTION OF THE DRAWINGS

The proposed process can be used in a wide variety of vessel types, as illustrated by the example shown in the accompanying drawings.

In the drawings.

DETAILED DESCRIPTION OF THE PREFERRED EMBODIMENTS

Figure 1:
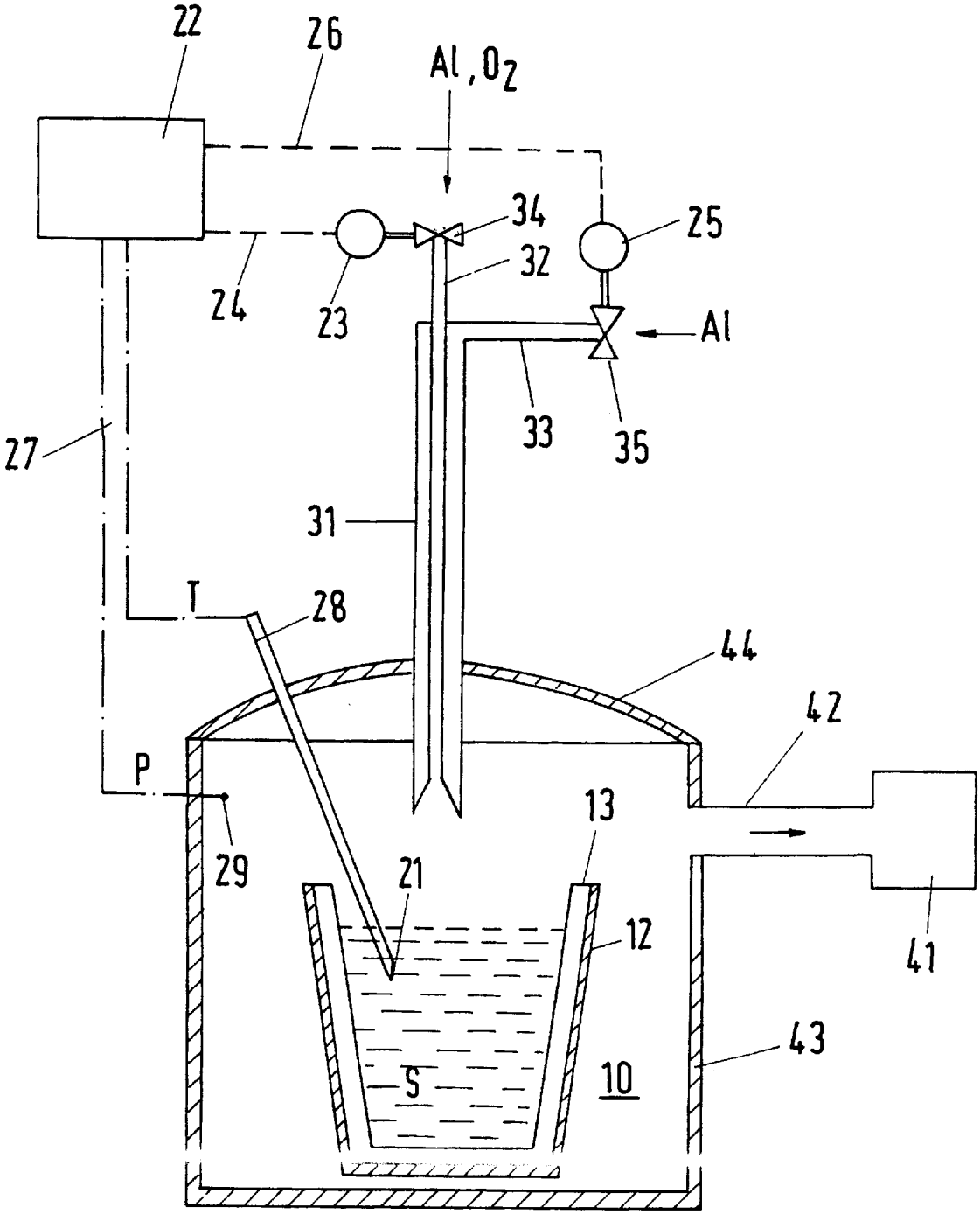
FIG. 1 shows an embodiment of a vacuum vessel for treating a steel melt according to the present invention.

FIG. 1 shows a vacuum vessel 43 equipped with a lid 44. The vacuum vessel 43 is connected via a suction line 42 to a vacuum unit 41. Located in the vacuum vessel 43 is a metallurgical vessel 10, which has a mantle 12 equipped, on the inside, with a refractory lining 13. The metallurgical vessel 10 is filled with a melt S.

A measurement lance 28 and a combination lance 31 extend through the lid 44.

The combination lance 31 has a feed line 32 for oxygen and a feed line 33 for metal substances such, for example, as aluminum powder, granular aluminum, or a combustible mixture of, for example, Al, Fe, Si, and Mn. A cut off-device 34 is connected to the feed line 32 and a cut-off device 35 is connected to the feed line 33. The cut-off devices 34 and 35 have control elements 23, 25, which are connected via control lines 24, 26 to a measurement and regulation device 22. The measurement and regulation device 22 is connected via a measurement line 27 to a measurement element 21 provided on the measurement lance 28 for the purpose of measuring the temperature T of the melt S as well as to a measurement element 29 for measuring the pressure P prevailing in the vaccuum vessel 43.

Figure 2:
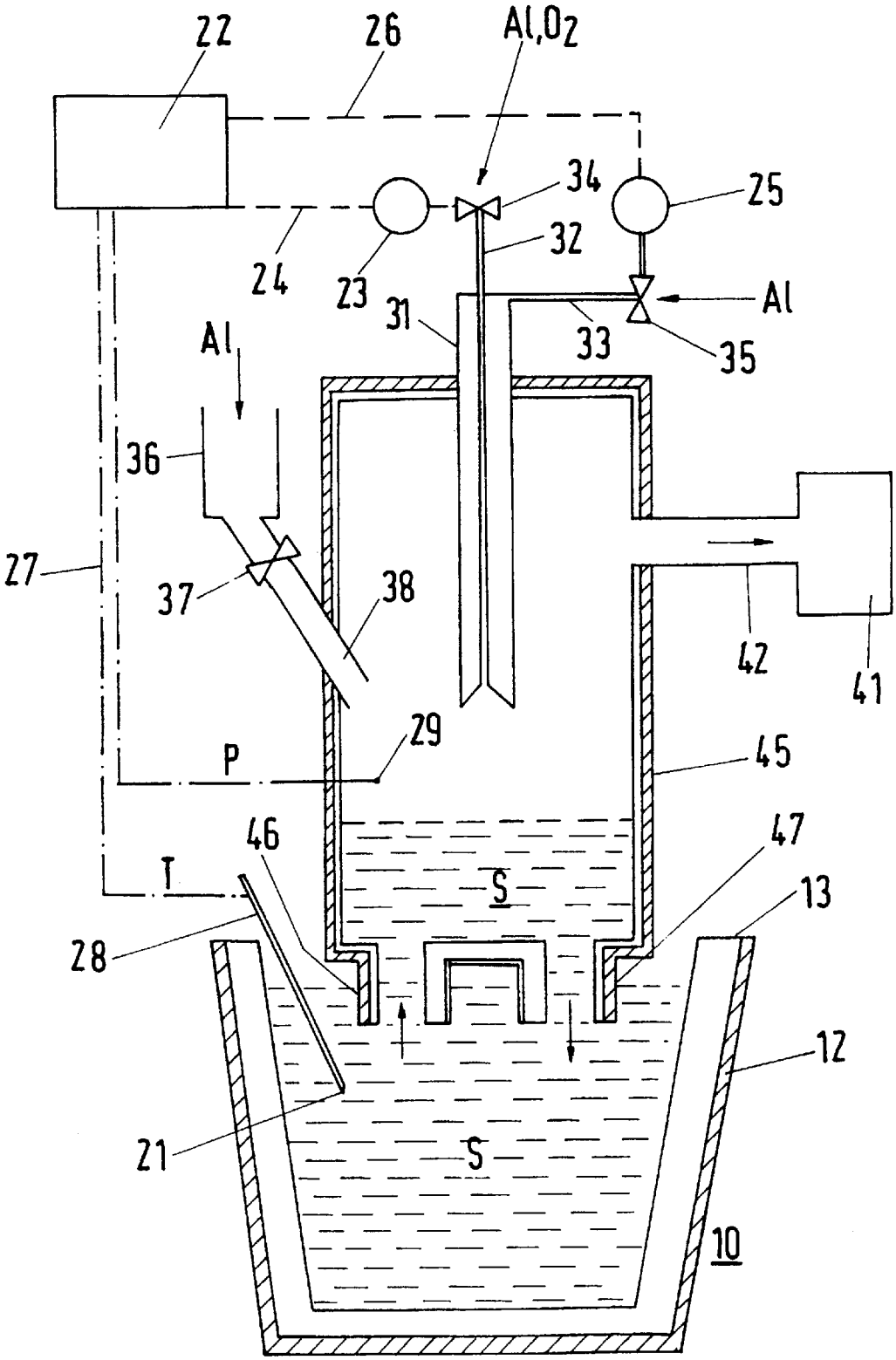
FIG. 2 shows an embodiment of an RH vessel for treating a steel melt according to the present invention.

FIG. 2 shows an open metallurgical vessel 10 filled with melt S. A supply tube 46 and an extraction tube 47 of an RH vessel 45 are submerged into the melt. The RH vessel 45 is connected via a suction line 42 to a vacuum unit 41. Along with a combination lance 31, a tube 38 for supplying especially coarse solids extends into the RH vessel 45 and is connected via a cut-off device 37 to A container 36. The measurement and regulation device 22 and the control elements 23, 25 are embodied as in FIG. 1.

Figure 3:
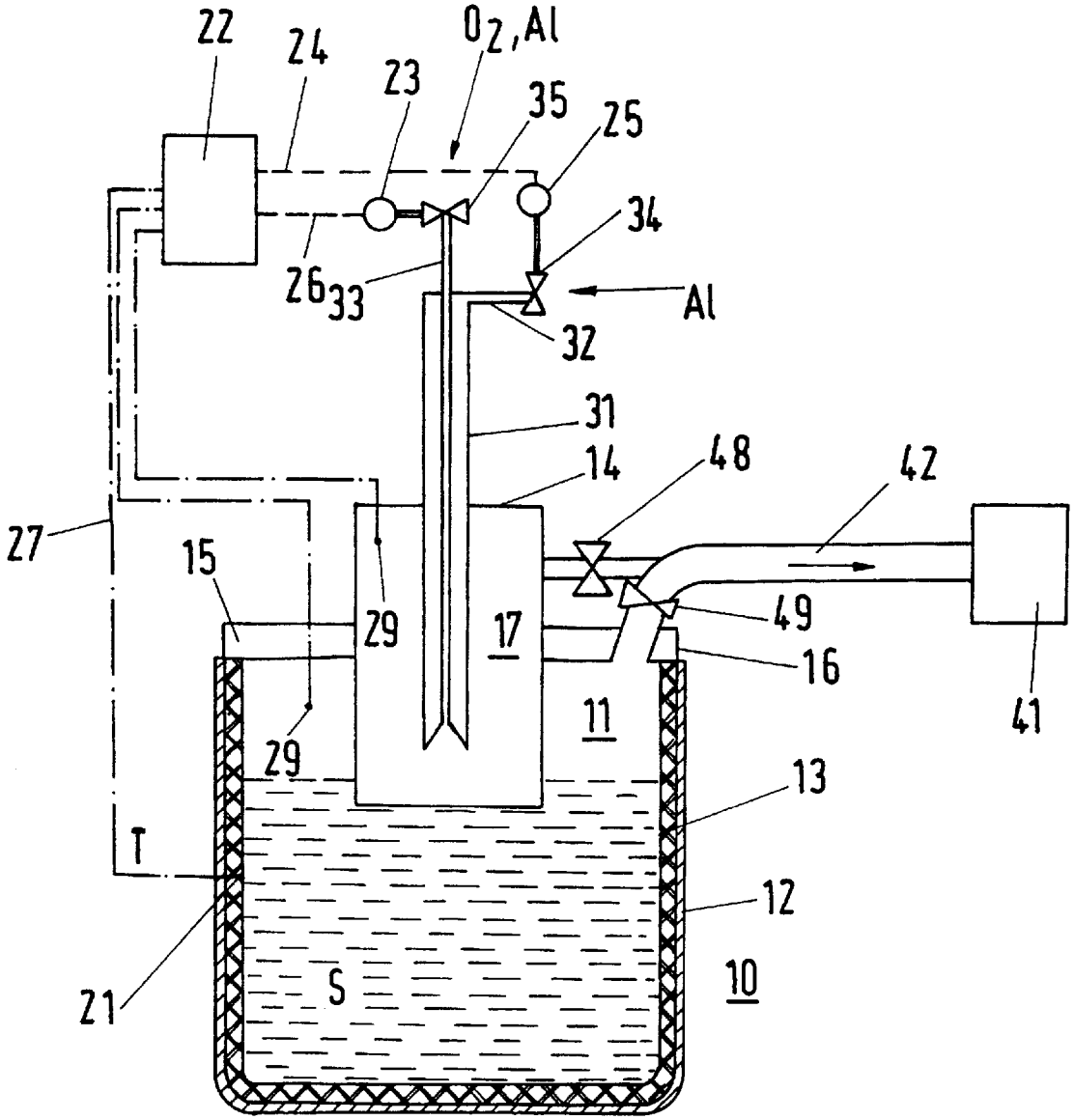
FIG. 3 shows an embodiment of a closed ladle for treating a steel melt according to the present invention.

FIG. 3 shows a vessel 10 that is closed by a lid 15 with a bell 14. An open side of the bell 14 faces downward and is submerged in the melt S located in the vessel 10.

The suction line 42 connected to the vacuum unit 41 comprises a first branch connected to to the bell 14 with a cut-off device 48 and a second branch inserted through the lid 15 with a cut-off device 49.

The measurement and regulation device 22 as well as the control elements 23, 25 are embodied as in FIGS. 1 and 2. The elements 29 are provided for the purpose of pressure measurement in both the interior 17 of the bell 14 as well as in the interior 11 of the vessel, here, the ladle 10.

The temperature measurement element 21 is run through the metal mantle 12 of the vessel 10 to deep inside the refractory lining 13, near the melt S.

What is claimed is:

1. A process for decarburizing a steel melt in a closed metallurgical vessel that is connected to a vacuum unit, comprising the steps of:

filling the closed metallurgical vessel with a steel melt comprising carbon;

adjusting the pressure in the closed metallurgical vessel to below 100 mbar;

introducing a replenishment supply of oxygen to the closed metallurgical vessel to implement decarburization of the steel melt to remove the carbon;

introducing a metallic combustible, substance at an even introduction rate to the closed metallurgical vessel after said step of introducing a replenishment supply of oxygen; and introducing an additional amount of oxygen during said step of introducing a metallic combustible substance needed to combust the metallic combustible substance during the decarburization of the steel melt, wherein said steps of introducing a metallic combustible substance and introducing an additional amount of oxygen are performed during the first 10 minutes following completion of said step of adjusting the pressure.

2. The process of claim 1, wherein said step of introducing a metallic combustible substance comprises introducing the metallic combustible substance at an even introduction rate.

3. The process of claim 1, wherein said step of introducing a metallic combustible substance comprises the step of introducing one of an aluminum powder, granular aluminum, or a combustible mixture.

4. The process of claim 3, wherein said step of introducing a metallic combustible substance comprises introducing the metallic combustible substance in discontinuous portions.

* * * * *